US010376906B2

(12) United States Patent
Zhang et al.

(10) Patent No.: US 10,376,906 B2
(45) Date of Patent: Aug. 13, 2019

(54) GAS AND LIQUID KNIFE AND CONTROL METHOD THEREOF

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventors: Hongbo Zhang, Beijing (CN); Qingqing Ma, Beijing (CN); Zhaozeng Wu, Beijing (CN); Yubao Zi, Beijing (CN); Zuhong Liu, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 15/677,127

(22) Filed: Aug. 15, 2017

(65) Prior Publication Data

US 2018/0078956 A1 Mar. 22, 2018

(30) Foreign Application Priority Data

Sep. 18, 2016 (CN) ..... 2016 1 0829242

(51) Int. Cl.

| | |
|---|---|
| ***B05C 17/10*** | (2006.01) |
| ***B05B 1/32*** | (2006.01) |
| ***B05B 1/00*** | (2006.01) |
| ***B05B 1/04*** | (2006.01) |
| ***B05B 1/26*** | (2006.01) |
| ***B05C 5/02*** | (2006.01) |

(52) U.S. Cl.

CPC ..... *B05B 1/326* (2013.01); *B05B 1/005* (2013.01); *B05B 1/044* (2013.01); *B05B 1/267* (2013.01); *B05C 5/0262* (2013.01)

(58) Field of Classification Search

CPC ..... B05C 5/0262; B05B 1/326; B05B 1/005; B05B 1/004; B05B 1/267

USPC ..... 239/11

See application file for complete search history.

(56) References Cited

U.S. PATENT DOCUMENTS 3,607,366 A * 9/1971 Kurokawa ..... B05C 11/06 118/63

3,917,888 A * 11/1975 Beam ..... C23C 2/20 427/433

(Continued)

*Primary Examiner* — Chee-Chong Lee

(74) *Attorney, Agent, or Firm* — Calfee, Halter & Griswold LLP

(57) ABSTRACT

A gas and liquid knife and a control method thereof are provided. The gas and liquid knife includes a chamber and a knife head. An ejection opening is provided at the knife head The knife head has a first knife lip and a second knife lip. The ejection opening is defined between a first inner wall of the first knife lip and a second inner wall of the second knife lip. The chamber is defined between the first wall plate and the second wall plate slidably connected with each other. The first knife lip connects to the first wall plate. The second knife lip connects to the second wall plate. The first knife lip and second knife lip moves relatively as the first wall plate and the second wall plate slides relatively, such that a minimum distance between the first inner wall and the second inner wall could be changed.

8 Claims, 9 Drawing Sheets

(56) References Cited

U.S. PATENT DOCUMENTS

| | | | | | |
|---|---|---|---|---|---|
| 4,041,895 | A * | 8/1977 | Overton | B05C 11/06 | 118/419 |
| 4,346,129 | A * | 8/1982 | Decker | C23C 2/20 | 118/419 |
| 5,074,242 | A * | 12/1991 | Bricmont | B05C 11/06 | 118/63 |
| 5,221,345 | A * | 6/1993 | Blankenship | B05C 11/06 | 118/419 |
| 8,113,139 | B2 * | 2/2012 | Kim | C23C 2/20 | 118/62 |

* cited by examiner

GAS AND LIQUID KNIFE AND CONTROL METHOD THEREOF

CROSS REFERENCE TO RELATED APPLICATIONS

This application claims the priority to and the benefit of Chinese Patent Application No. 201610829242.0, filed on Sep. 18, 2016, which is incorporated herein by reference in its entirety.

TECHNICAL FIELD

The present disclosure relates generally to the technical field of mechanical equipment, and particularly to a gas and liquid knife and a control method thereof.

BACKGROUND

According to kind of ejected fluid, a gas and liquid knife could be divided into two kinds, i.e., gas knife and liquid knife. The gas knife is generally used to cut off liquid via gas flow; while the liquid knife is generally used to pre-wet product by ejecting liquid.

A gas and liquid knife according to prior art, as shown in FIG. 1, includes a chamber 01 and two knife lips 02 and 03 extending from the chamber 01. The two knife lips 02 and 03 are sheets parallel with each other. A gap x between the two knife lips communicates with internal of the chamber. One end of the gap away from the chamber forms an ejection opening k. An inlet 04 is formed at the chamber 01. Gas or liquid at high speed runs into the chamber 01 via the inlet 04 and then ejects out via the ejection opening k. During ejection, the gas or liquid will be restricted by the knife lips 02 and 03 so as to eject in one direction. A distance between the knife lips 02 and 03 is a width of the ejection opening k, which generally could be reduced by adhering shim at inner side of the knife lip 02 or knife lip 03.

SUMMARY

The embodiments of the present disclosure provide the following technical solution, so as to achieve an effect of the present disclosure.

In one aspect, the present disclosure provides a gas and liquid knife, comprising:

a chamber and a knife head provided at the chamber;

an ejection opening is provided at the knife head, which communicates with an internal of the chamber;

the knife head has a first knife lip and a second knife lip, the ejection opening is defined between a first inner wall of the first knife lip and a second inner wall of the second knife lip;

the chamber is defined between the first wall plate and the second wall plate slidably connected with each other, and provided with an inlet; the first knife lip connects to the first wall plate, and the second knife lip connects to the second wall plate, the first knife lip and second knife lip moves relatively as the first wall plate and the second wall plate slides relatively, such that a minimum distance between the first inner wall and the second inner wall could be changed.

In another aspect, the present disclosure provides a control method of a gas and liquid knife, the gas and liquid knife comprises a chamber and a knife head provided at the chamber; an ejection opening is provided at the knife head, which communicates with an internal of the chamber; the knife head has a first knife lip and a second knife lip, the ejection opening is defined between a first inner wall of the first knife lip and a second inner wall of the second knife lip;

the chamber is defined between the first wall plate and the second wall plate slidably connected with each other and provided with an inlet; the first knife lip connects to the first wall plate, and the second knife lip connects to the second wall plate, the first knife lip and second knife lip moves relatively as the first wall plate and the second wall plate slides relatively, such that a minimum distance between the first inner wall and the second inner wall could be changed;

the control method comprising:

obtaining a preset width of the ejection opening;

controlling the first wall plate and the second wall plate to slide relatively until the minimum distance between the first inner wall and the second inner wall is equal to the preset width of the ejection opening; and injecting gas or liquid into the chamber via the inlet, and ejecting the gas or liquid via the ejection opening.

BRIEF DESCRIPTION OF THE DRAWINGS

In order to clarify technical aspects in embodiments of the present disclosure more clearly, drawings which are needed for the description of the embodiments are briefly described hereinafter. It will be apparent that the drawings in the following description are merely some embodiments of the present disclosure. Other drawings may be obtained according to these drawings by those skilled in the art, without creative labor.

FIG. 2-1 is a schematic diagram illustrating a structure of a gas and liquid knife according to an embodiment of the present disclosure;

FIG. 2-2 is a left view of the gas and liquid knife as shown in FIG. 2-1;

FIG. 3-1 is a schematic diagram illustrating a structure of another gas and liquid knife according to an embodiment of the present disclosure;

FIG. 3-2 is a schematic diagram illustrating a structure of another gas and liquid knife according to an embodiment of the present disclosure;

FIG. 3-3 is a schematic diagram illustrating an external structure of the gas and liquid knife as shown in FIG. 3-2;

FIG. 3-4 is a schematic diagram illustrating a structure of another gas and liquid knife according to an embodiment of the present disclosure;

FIG. 3-5 is a right view of the gas and liquid knife as shown in FIG. 3-4; and FIG. 4 is a flow chart of a control method of the gas and liquid knife according to the embodiment of the present disclosure.

Specific embodiments in this disclosure have been shown by way of example in the foregoing drawings and are hereinafter described in detail. The figures and written description are not intended to limit the scope of the inventive concepts in any manner. Rather, they are provided to illustrate the inventive concepts to a person skilled in the art by reference to particular embodiments.

DETAILED DESCRIPTION

Exemplary embodiments will be specifically and completely described as follows combining with drawings. It will be appreciated that the embodiments as described are merely parts of embodiments according to the present disclosure, not the whole. Other embodiments obtained by those skilled in the art without creative labor are intended to fall within the scope of the disclosure.

Figure 1:
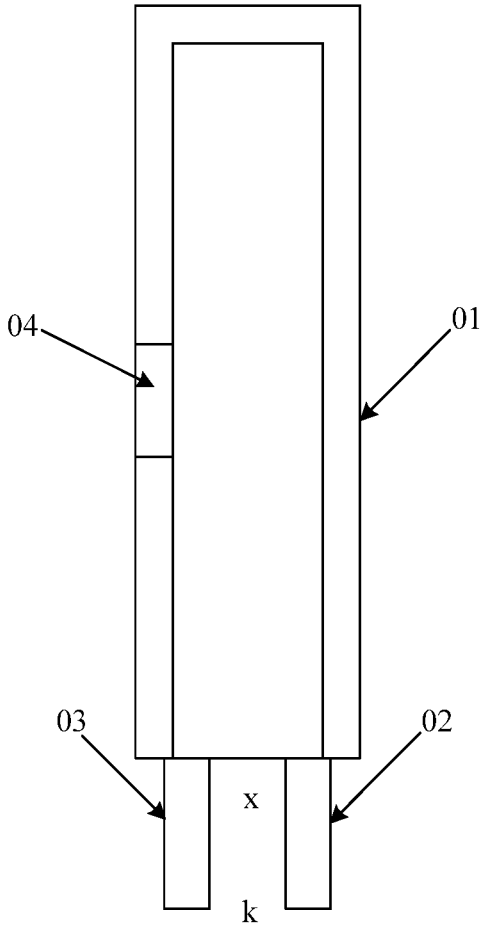
FIG. 1 is a schematic diagram illustrating a structure of a gas and liquid knife according to prior art.
Figures 1, 2:
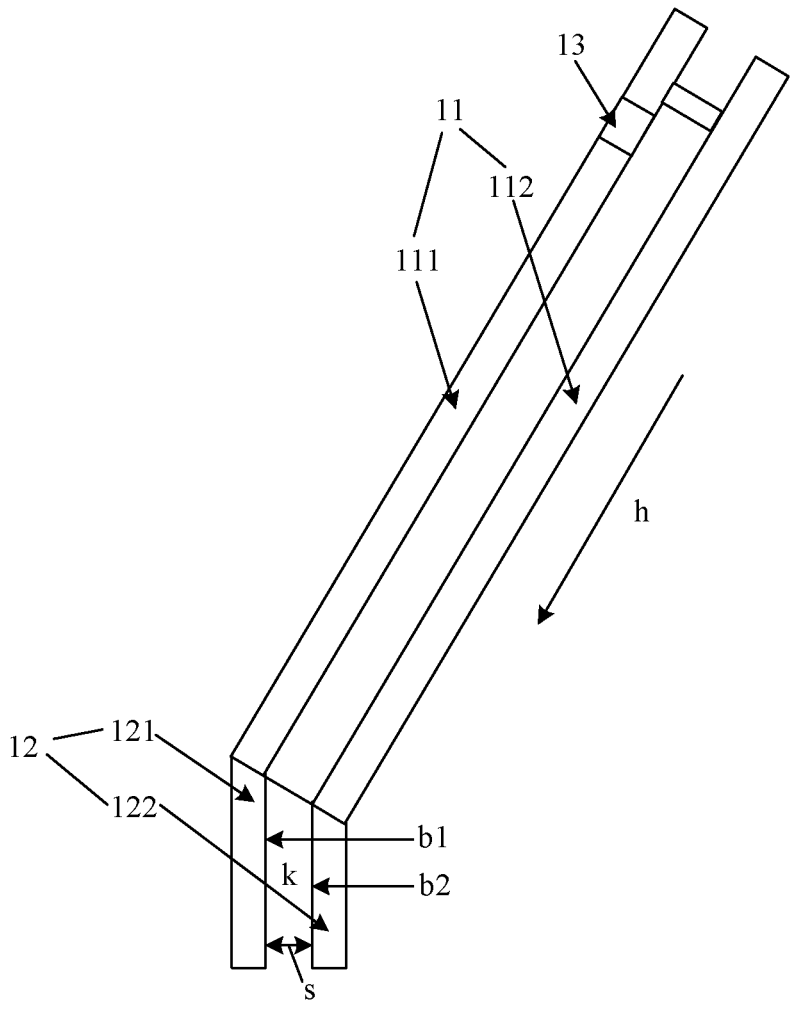
Figure 2:
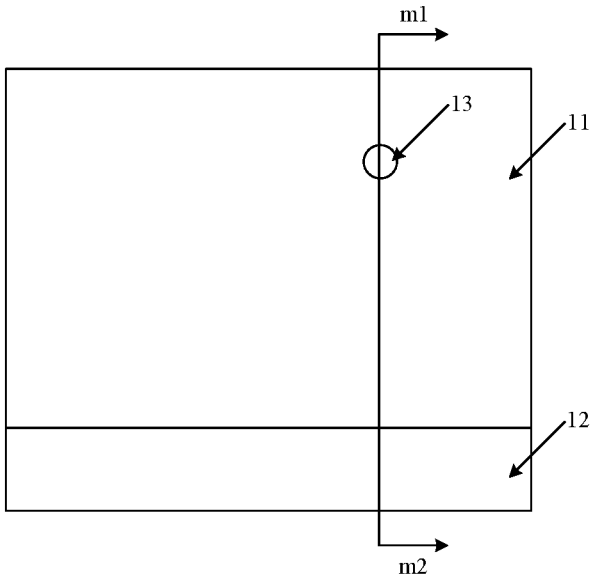

FIG. 2-1 is a schematic diagram illustrating a structure of a gas and liquid knife according to an embodiment of the present disclosure. The gas and liquid knife includes a chamber 11 and a knife head 12 provided at the chamber 11.

An ejection opening k is provided at the knife head 12, which communicates with an internal of the chamber 11.

The knife head 12 has a first knife lip 121 and a second knife lip 122. The ejection opening k is defined between a first inner wall b1 of the first knife lip 121 and a second inner wall b2 of the second knife lip 122.

The chamber 11 is defined between the first wall plate 111 and the second wall plate 112 slidably connected with each other. The first knife lip 121 connects to the first wall plate 111, and the second knife lip 122 connects to the second wall plate 112. The first knife lip 121 and second knife lip 122 moves relatively as the first wall plate 111 and the second wall plate 112 slides relatively (i.e., the first wall plate 111 slides relative to the second wall plate 112 in direction h or opposite to h), such that a minimum distance s between the first inner wall b1 and the second inner wall b2, i.e., a width of the ejection opening k, will be changed. An inlet 13 is formed at the chamber 11 through which gas or liquid is allowed to be injected.

The first inner wall b1 and the second inner wall b2 of the gas and liquid knife may be parallel with each other as shown in FIG. 2-1, or have angle therebetween, which is not limited in embodiments of the present disclosure.

As shown in FIG. 2-1, as the first wall plate 111 slides relative to the second wall plate 112 in direction h, the minimum distance s between the first inner wall b1 and the second inner wall b2 becomes larger; while as the first wall plate 111 slides relative to the second wall plate 112 in direction opposite to h, the minimum distance s between the first inner wall b1 and the second inner wall b2 becomes smaller. It should be noted that FIG. 2-1 illustrates a cross-sectional view of the gas and liquid knife, and a left view of the gas and liquid knife may be as shown in FIG. 2-2. In FIG. 2-2, reference number 11 refers to the chamber, and reference number 12 refers to the knife head. FIG. 2-1 may illustrate a cross-sectional view of the gas and liquid knife along line m1-m2 in FIG. 2-2.

It should be noted that during the relative slide of the first wall plate 111 and the second wall plate 112, the chamber 11 is closed except the position where the inlet 13 and the ejection opening k are provided.

Consequently, in the gas and liquid knife according to the present disclosure, the ejection opening is defined between the inner walls of the two knife lips, and the minimum distance between the inner walls of the two knife lips could be changed by relatively moving the two knife lips, which solves the problem of big error of the width of the ejection opening caused by shim with error thickness and compactness during adjusting the width of the ejection opening by adhering shim in prior art, thereby achieving an effect of adjusting the width of the ejection opening with little error.

Figures 1, 3:
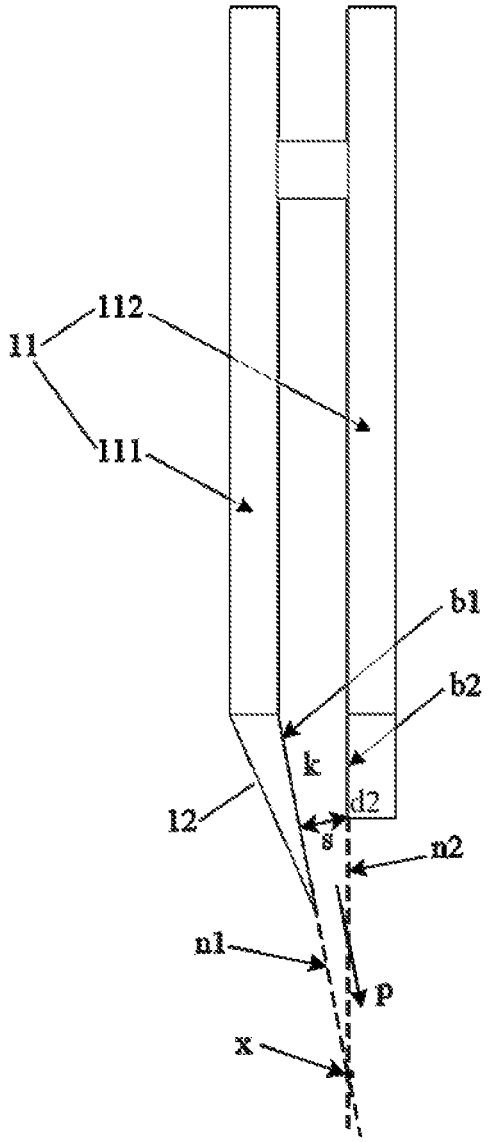
Figures 2, 3:
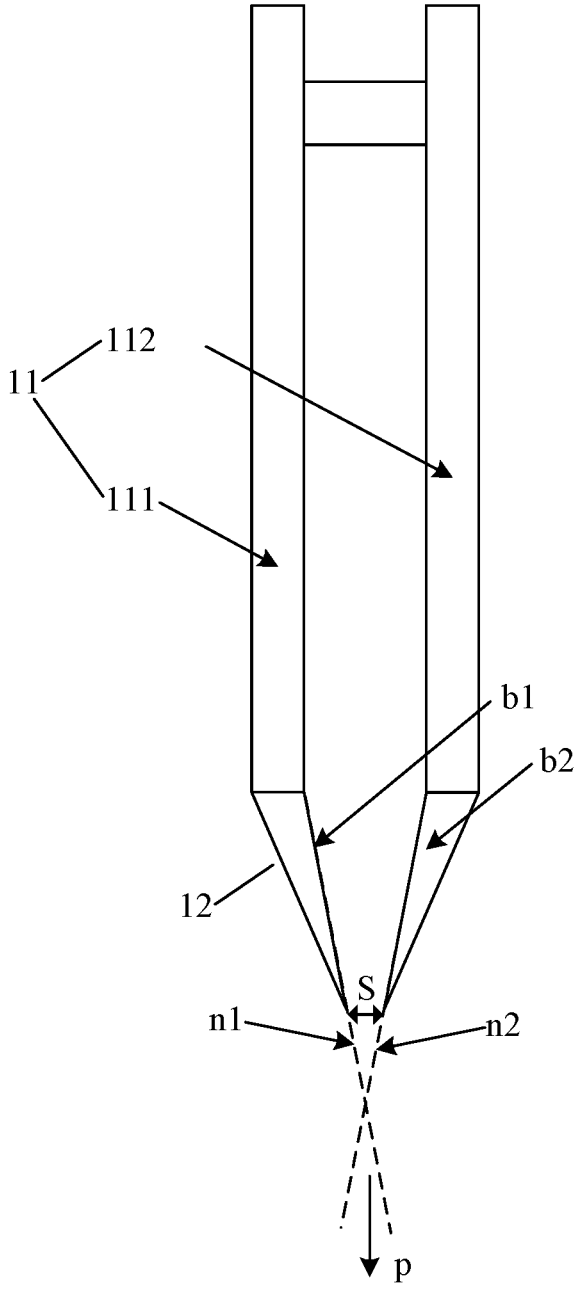
Figure 3:
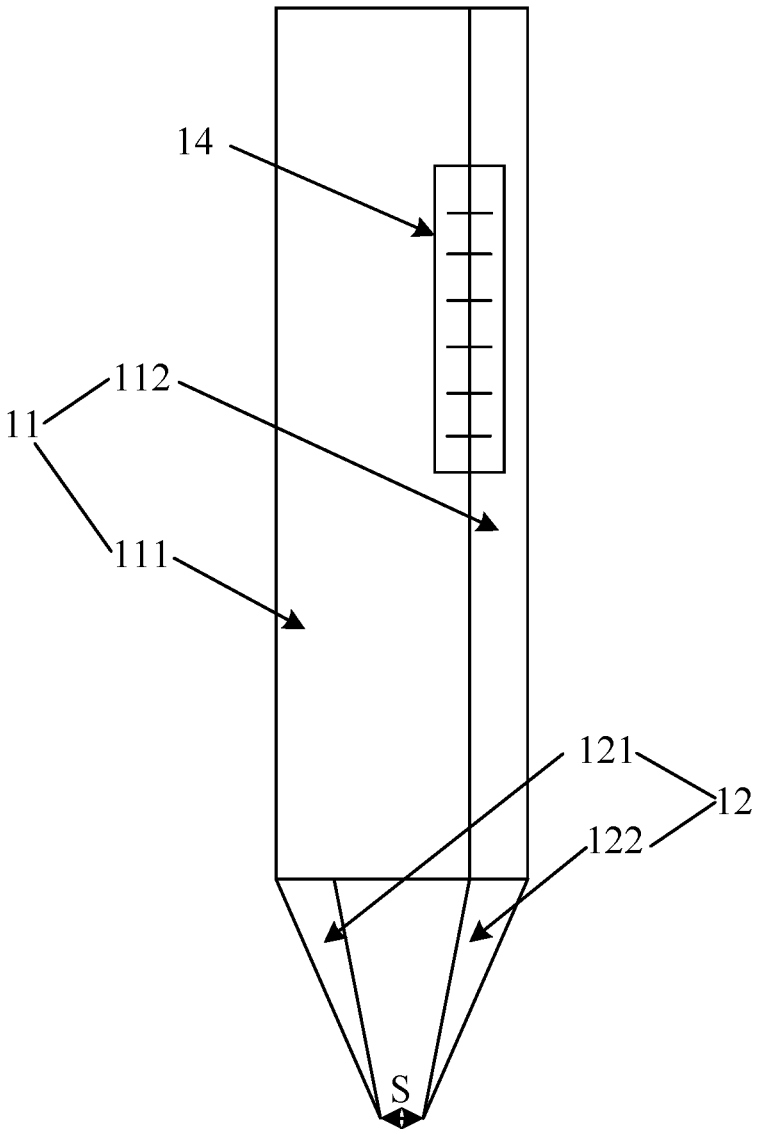

Further, as shown in FIG. 3-1 which illustrates a structure of another gas and liquid knife according to an embodiment of the present disclosure. In the present embodiment, a preferable element is added based on the gas and liquid knife as shown in FIG. 2-1, which brings about better performance for the gas and liquid knife according to the present embodiment.

A plane n1 of the first inner wall b1 and a plane n2 of the second inner wall b2 intersect and create an intersection line x (the intersection line x is perpendicular to the paper as shown in FIG. 3-1) unparalleled with an ejection direction p of the ejection opening k. The minimum distance s between the first inner wall b1 and the second inner wall b2 (i.e., the width of the ejection opening k, the minimum distance s may be a vertical distance from an end d2 of the second inner wall b2 away from the second wall plate 112 to the first inner wall b1) is reduced along the ejection direction p. Therefore, as the first wall plate 111 slides relatively to the second wall plate 112, the minimum distance s between the first inner wall b1 and the second inner wall b2 becomes larger or smaller, thereby achieving an effect of adjusting the width of the ejection opening k.

It should be noted that, as the angle between the first inner wall b1 and the second inner wall b2 becomes small, during relative slide of the first wall plate 111 and the second wall plate 112, the minimum distance s between the first inner wall b1 and the second inner wall b2 changes slowly, such that accuracy of adjustment for the width of the ejection opening k becomes higher; on the contrary, as the angle between the first inner wall b1 and the second inner wall b2 becomes large, during relative slide of the first wall plate 111 and the second wall plate 112, the minimum distance s between the first inner wall b1 and the second inner wall b2 changes quickly, such that accuracy of adjustment for the width of the ejection opening k becomes lower.

Alternatively, the intersection line x defined by the plane n1 of the first inner wall b1 and the plane n2 of the second inner wall b2 is perpendicular to the ejection direction p of the ejection opening k.

As shown in FIG. 3-2 which illustrates a structure of another gas and liquid knife according to an embodiment of the present disclosure, an angle is existed between the plane n1 of the first inner wall b1 and the ejection direction p, and an angle is existed between the plane n2 of the second inner wall b2 and the ejection direction p. FIG. 3-2 illustrates a cross-sectional of the gas and liquid knife, where the explanation of other reference numerals may refer to FIG. 3-1, which will not be redundantly explained.

As shown in FIG. 3-3 which illustrates an external structure of the gas and liquid knife as shown in FIG. 3-2, the gas and liquid knife further includes a scale assembly 14 disposed at the first wall plate 111 and the second wall plate 112 for illustrating a relative moving distance between the first knife lip 121 and second knife lip 122, which could improve accuracy of adjustment for the width of the ejection opening. The explanation of other reference numerals as shown in FIG. 3-3 may refer to FIG. 3-1, which will not be redundantly explained.

Figures 3, 4:
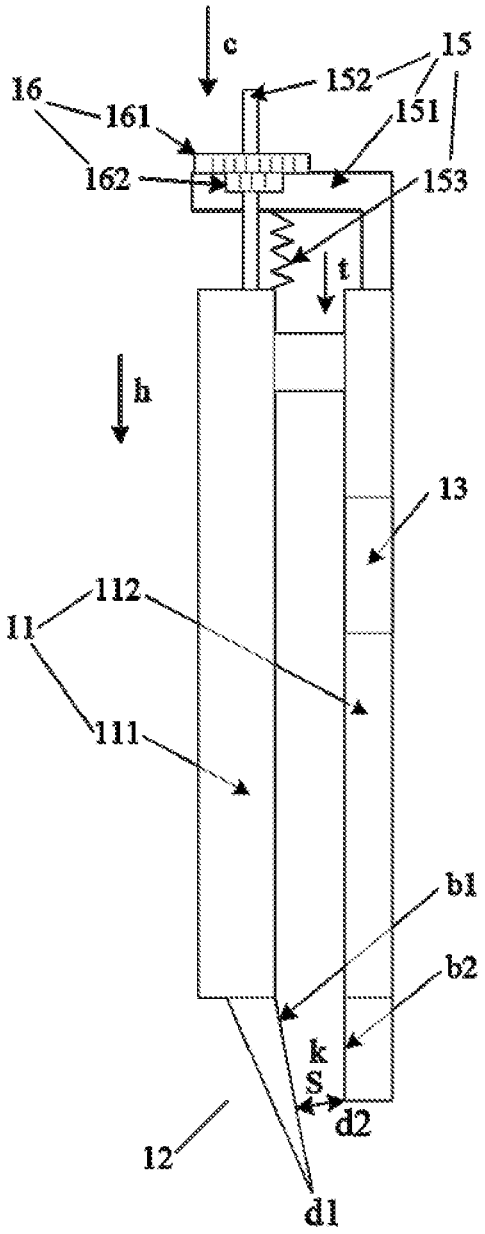

As shown in FIG. 3-4 which illustrates a structure of another gas and liquid knife according to an embodiment of the present disclosure, the gas and liquid knife further includes a movement assembly 15 having a holder 151 and an adjusting screw 152. The holder 151 connects to the second wall plate 112, and the adjusting screw 152 movably connects to the holder 151 and threaded connects to the first wall plate 111. A length direction c of the adjusting screw 152 is parallel to a slide direction h of the first wall plate 111 relative to the second wall plate 112. As rotation of the adjusting screw 152, the first wall plate 111 slides relatively to the second wall plate 112 accordingly.

Alternatively, the gas and liquid knife further includes a measure assembly 16 having a dial 161 and a scale mark portion 162 for illustrating a relative movement distance between the first knife lip 121 and second knife lip 122. The dial 161 fixedly connects to the adjusting screw 152, and the scale mark portion 162 is provided on the holder 151. Signs on the dial 161 may be corresponding to the width of the ejection opening k (the explanation of the width of the ejection opening may refer to FIG. 3-1, which is not redundantly explained), which is convenient for adjusting the width of the ejection opening k by rotating the dial by an operator.

Figures 3, 4, 5:
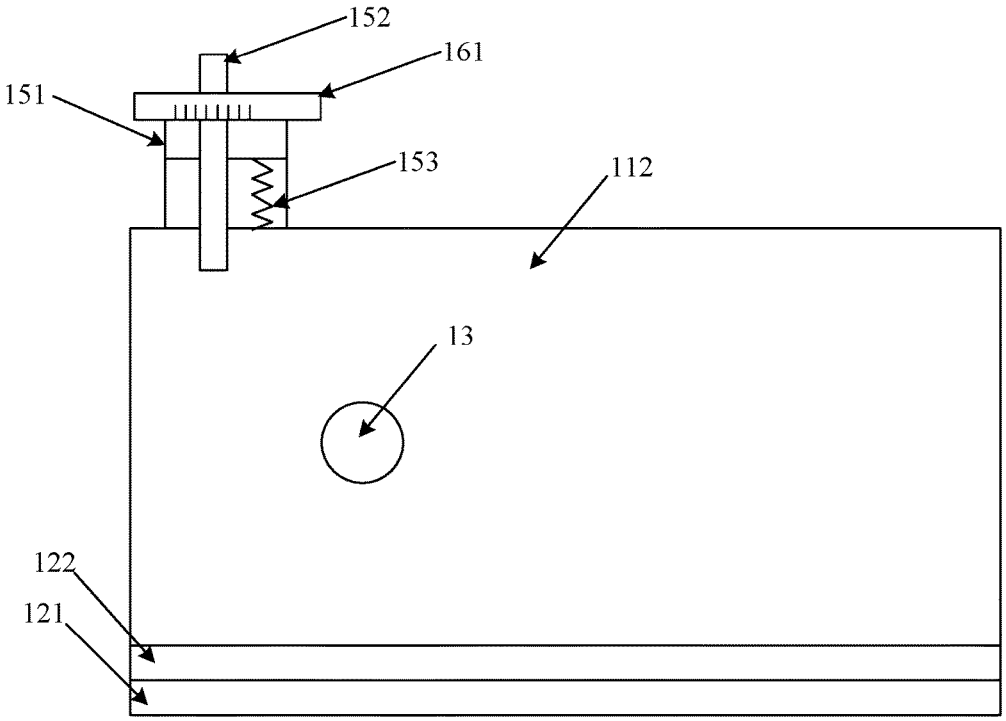
Figure 4:
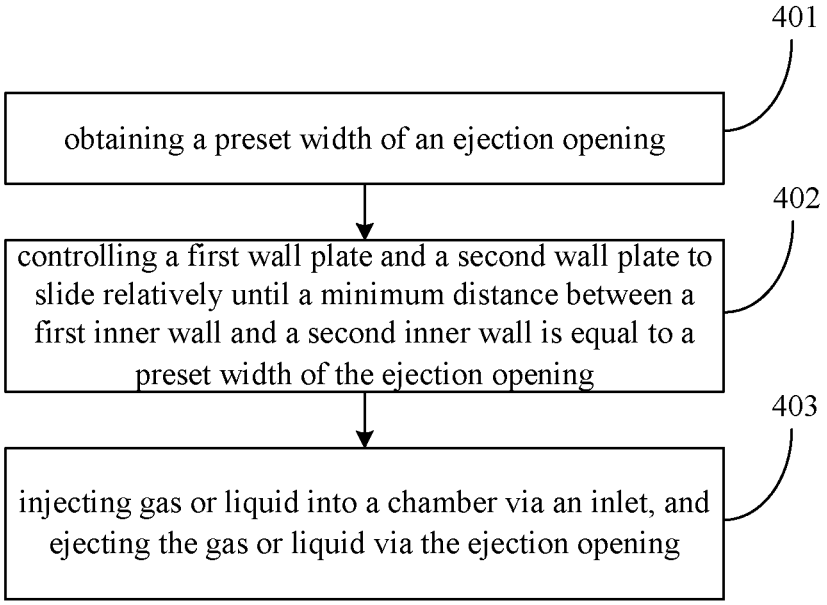

As shown in FIG. 3-5 which illustrates a right view of the gas and liquid knife as shown in FIG. 3-4, the gas and liquid knife further includes an inlet 13 formed at the second wall plate 112. The second knife lip 122 connects to a lower end of the wall plate 112, and a lower edge of the second knife lip 122 (i.e., the edge away from the second wall plate 112) is parallel to a lower edge of the first knife lip 121. The explanation of other reference numerals as shown in FIG. 3-5 may refer to FIG. 3-4, which will not be redundantly explained.

As shown in FIG. 3-4, the movement assembly 15 further includes a spring 153 with one end connecting to the holder 151 and the other end connecting to the first wall plate 111. A length direction t of the spring 153 is parallel to the length direction c of the adjusting screw 152. The dial 161 is kept to be pushed tightly against the holder 151 by the spring 153 so as to avoid error.

Alternatively, the first inner wall b1 and the second inner wall b2 are rectangle, and an end of the first inner wall b1 away from the first wall plate 111 is parallel to an end of the second inner wall b2 away from the second wall plate 112, which allows air or liquid curtain ejected from the ejection opening k is uniform. The ejection opening may be rectangle, and the width of the ejection opening is equated with the width of a rectangle, length of which depends on the length of the first inner wall b1 and the second inner wall b2.

The explanation of other reference numerals as shown in FIG. 3-4 may refer to FIG. 3-1, which will not be redundantly explained.

During manufacturing, a display substrate to be treated requires a large mount of drug liquid. Before treated by the drug liquid, the display substrate may be pre-wetted by a liquid curtain ejected from the gas and liquid knife according to the embodiment of the present disclosure so as to prevent adverse event; when the display substrate has been treated by the drug liquid, the gas and liquid knife according to the embodiment of the present disclosure could eject a gas curtain to forming a partition for the drug liquid so as to reduce the amount of the drug liquid carried out by the display substrate, thereby reducing waste and pollution. Meanwhile, after cleared by water, the display substrate may be blown dry by the gas curtain ejected from the gas and liquid knife according to the embodiment of the present disclosure so as to prevent effect by waterlogging during following process.

Consequently, in the gas and liquid knife according to the present disclosure, the ejection opening is defined between the inner walls of the two knife lips, and the minimum distance between the inner walls of the two knife lips could be changed by relatively moving the two knife lips, which solves the problem of big error of the width of the ejection opening caused by shim with error thickness and compactness during adjusting the width of the ejection opening by adhering shim in prior art, thereby achieving an effect of adjusting the width of the ejection opening with little error.

FIG. 4 illustrates a flow chart of a control method of the gas and liquid knife according to the embodiment of the present disclosure for controlling the gas and liquid knife as shown in FIG. 2-1, FIG. 3-1, FIG. 3-2 or FIG. 3-4, which includes:

Step 401, obtaining a preset width of the ejection opening.

During performing the control method of the gas and liquid knife according to the embodiment of the present disclosure, the preset width of the ejection opening may be obtained as first, which could be set by operator.

It should be noted that the subject for performing the control method of the gas and liquid knife according to the embodiment of the present disclosure may be a controller for controlling the gas and liquid knife. The controller may include an integrated circuit, processor or the like. The operator could set the preset width of the ejection opening by the controller.

Step 402, controlling the first wall plate and the second wall plate to slide relatively until the minimum distance between the first inner wall and the second inner wall is equal to the preset width of the ejection opening.

After the preset width of the ejection opening is obtained, the first wall plate and the second wall plate could be controlled to slide relatively, such that the minimum distance between the first inner wall and the second inner wall, i.e., the width of the ejection opening, could be equal to the preset width of the ejection opening.

Step 403, injecting gas or liquid into the chamber via the inlet, and ejecting the gas or liquid via the ejection opening.

In the case that the minimum distance between the first inner wall and the second inner wall is equal to the preset width of the ejection opening, gas or liquid may be injected into the chamber via the inlet, and then ejected via the ejection opening.

In the following detail is described by taking the gas and liquid knife as shown in FIG. 3-4 to be controlled as an example:

During controlling the gas and liquid knife as shown in FIG. 3-4, at first, obtaining a desirable width g1 of the ejection opening, then rotating the dial 161 according to a current width g2 of the ejection opening as shown by the measure assembly 16, such that the adjusting screw 152 is able to slide the first wall plate 111 relative to the second wall plate 112, accordingly the first inner wall b1 and the second inner wall b2 move relatively, which results in changes in the minimum distance between the first inner wall b1 and the second inner wall b2; finishing adjustment for the width of the ejection opening until the distance of the ejection opening as shown by the measure assembly 16 becomes g1; then injecting gas or liquid at high pressure into the chamber via the inlet 13, and ejecting the gas or liquid at high pressure via the ejection opening k to form the gas or liquid curtain.

Consequently, in the gas and liquid knife according to the present disclosure, the ejection opening is defined between the inner walls of the two knife lips, and the minimum distance between the inner walls of the two knife lips could be changed by relatively moving the two knife lips, which solves the problem of big error of the width of the ejection opening caused by shim with error thickness and compactness during adjusting the width of the ejection opening by adhering shim in prior art, thereby achieving an effect of adjusting the width of the ejection opening with little error.

It should be understood for those skilled in the art that a part of or the whole of steps in the embodiments may be implemented by hardware, or by programs instructing the related hardware. The programs may be stored in a computer readable medium. The storage medium described as above may be a red-only memory, a magnetic disc, an optical disc or the like.

It will be appreciated by those skilled in the art that the disclosure is not limited the disclosed embodiments; one of ordinary skill in the art can make various changes and modifications to the present disclosure without departing from the spirit and scope of the invention. Thus, the present disclosure intends to encompass such changes and modifications provided that those changes and modifications fall within the scope of claims of the present invention and equivalents thereof.

What is claimed is:

1. A gas and liquid knife, comprising:

a chamber and a knife head provided at the chamber;

an ejection opening is provided at the knife head, which communicates with an internal of the chamber;

wherein the knife head has a first knife lip and a second knife lip, the ejection opening is defined between a first inner wall of the first knife lip and a second inner wall of the second knife lip;

wherein the chamber has a first wall plate and a second wall plate slidably connected with each other, and provided with an inlet; the first knife lip connects to the first wall plate, and the second knife lip connects to the second wall plate, the first knife lip and second knife lip moves relatively as the first wall plate and the second wall plate slides relatively, such that a minimum distance between the first inner wall and the second inner wall could be changed;

a measure assembly having a dial and a scale mark portion for illustrating a relative movement distance between the first knife lip and second knife lip;

the dial is fixedly connected to the adjusting screw, and the scale mark portion is provided on the holder.

2. The gas and liquid knife according to claim 1, wherein a plane of the first inner wall and a plane of the second inner wall intersect and create an intersection line unparalleled with an ejection direction of the ejection opening; and the minimum distance between the first inner wall and the second inner wall is reduced along the ejection direction.

3. The gas and liquid knife according to claim 2, wherein the intersection line defined by the plane of the first inner wall and the plane of the second inner wall is perpendicular to the ejection direction of the ejection opening.

4. The gas and liquid knife according to claim 2, wherein an angle is existed between the plane of the first inner wall and the ejection direction, and an angle is existed between the plane of the second inner wall and the ejection direction.

5. The gas and liquid knife according to claim 1, further comprising a scale assembly disposed at the first wall plate and the second wall plate for illustrating a relative moving distance between the first knife lip and second knife lip.

6. The gas and liquid knife according to claim 1, further comprising a movement assembly having a holder and an adjusting screw;

wherein the holder connects to the second wall plate, and the adjusting screw movably connects to the holder and threaded connects to the first wall plate; a length direction of the adjusting screw is parallel to a slide direction of the first wall plate relative to the second wall plate; as rotation of the adjusting screw, the first wall plate slides relatively to the second wall plate accordingly.

7. The gas and liquid knife according to claim 1, wherein the first inner wall and the second inner wall are rectangle, and an end of the first inner wall away from the first wall plate is parallel to an end of the second inner wall away from the second wall plate.

8. The gas and liquid knife according to claim 1, wherein the movement assembly further comprises a spring with one end connecting to the holder and the other end connecting to the first wall plate; and a length direction of the spring is parallel to the length direction of the adjusting screw.

* * * * *